US009803350B2

(12) United States Patent
Guthrie et al.

(10) Patent No.: US 9,803,350 B2
(45) Date of Patent: Oct. 31, 2017

(54) FLUSH LEVER AND ASSEMBLY

(71) Applicant: Lavelle Industries, Inc., Burlington, WI (US)

(72) Inventors: Kevin J. Guthrie, Wind Lake, WI (US); Jordan D. Smith, New Berlin, WI (US)

(73) Assignee: Lavelle Industries, Inc., Burlington, WI (US)

( * ) Notice: Subject to any disclaimer, the term of this patent is extended or adjusted under 35 U.S.C. 154(b) by 62 days.

(21) Appl. No.: 14/928,113

(22) Filed: Oct. 30, 2015

(65) Prior Publication Data

US 2016/0122990 A1 May 5, 2016

Related U.S. Application Data

(60) Provisional application No. 62/073,389, filed on Oct. 31, 2014.

(51) Int. Cl.
*E03D 5/00* (2006.01)
*E03D 5/092* (2006.01)
*E03D 5/09* (2006.01)

(52) U.S. Cl.
CPC ..... *E03D 5/092* (2013.01); *E03D 5/09* (2013.01)

(58) Field of Classification Search
CPC ..... E03D 5/092; E03D 5/09
USPC ..... 4/405
See application file for complete search history.

(56) References Cited

U.S. PATENT DOCUMENTS

| | | | | |
|---|---|---|---|---|
| 7,343,275 | B2 * | 3/2008 | Lenormand | E21B 49/00 702/13 |
| 2007/0240256 | A1 * | 10/2007 | Tau | E03D 5/092 4/405 |
| 2008/0115263 | A1 * | 5/2008 | Siena | E03D 5/094 4/405 |
| 2012/0124727 | A1 * | 5/2012 | Davis | E03D 5/02 4/405 |
| 2014/0259342 | A1 * | 9/2014 | Le | E03D 5/092 4/249 |
| 2014/0289946 | A1 * | 10/2014 | Tanimoto | E03D 5/094 4/405 |

* cited by examiner

*Primary Examiner* — Huyen Le
(74) *Attorney, Agent, or Firm* — Joseph S. Heino; James E. Lowe

(57) ABSTRACT

A flush lever comprises a handle and a skirt, or escutcheon plate, both disposed to the exterior of a toilet tank. Within the tank is a flush lever subassembly, the subassembly taking one of two different embodiments and each embodiment comprising means for mechanically linking the flush lever with the subassembly. One portion of the flush lever can be variably adjustable within 360° of rotation and by adjustments every 15° for optimal placement of the flush lever as desired or required. Another portion of the flush lever can be variably adjustable within 180° of rotation as well and by adjustments also every 15°.

18 Claims, 4 Drawing Sheets

FLUSH LEVER AND ASSEMBLY

This application claims the benefit of U.S. Provisional Application No. 62/073,389 filed Oct. 31, 2014.

FIELD OF THE INVENTION

The present invention relates generally to plumbing fixtures and to the component parts that are used in them. More particularly, it relates to a flush lever of the type that is used in gravity flush toilets. It also relates to such a flush lever that is able to be mounted in a variety of positions relative to the tank of the flush toilet.

BACKGROUND OF THE INVENTION

Conventional toilets typically employ a number of essential components. First, a porcelain water tank is mounted immediately above a porcelain bowl from which a quantity of water is rapidly drained in order to flush waste from the bowl into a sewer system. One very common design uses a flapper valve made of an elastomeric material that covers the drain outlet of the tank. When the flush handle on the outside of the tank is manually actuated, typically by pushing the handle downwardly, the flapper valve is lifted by means of a flush lever via a chain or other connecting means. This allows the head of water in the tank to drain through the flush valve and the drain outlet. The flapper valve is typically designed with an inverted air chamber so that it initially floats as it is lifted away from the drain outlet in the bottom of the tank. This allows sufficient flushing water to flow into the bowl even if the user immediately releases the flush handle. When the water level in the tank drops, the tank is automatically refilled through a fill valve connected to a water supply line.

Current flush levers used with toilet tanks typically comprise a rotatable handle disposed to the tank exterior, a flush lever disposed within the tank interior and a mechanical coupling disposed between the rotatable handle and the flush lever. The mechanical coupling extends through an aperture defined within a tank wall that separates the tank exterior and the tank interior, the tank interior comprising the vessel for storing that amount of water that is used to flush the toilet upon rotation of the aforementioned rotatable handle. Actuation of the flush lever is accomplished by pushing the end of the rotatable handle downwardly (or rearwardly depending on the handle's orientation), thereby lifting the flush lever about a central pivot point. All of this mechanical action relies essentially on gravity, the flush lever and flapper valve typically being heavier than the flush handle, and on the flotation of the flapper valve within the tank.

In the view of this inventor, there is a need to allow the flush lever and the rotatable handle to be mounted such that it can be operated in a number of different ways. For example, one operational position, the handle is a standard front left mount (as viewed by a user standing and facing the toilet bowl), with the handle being disposed in a horizontal position with handle rotation being downward. Another is the same type of mount, but where the horizontal handle is positioned on the left side of the tank, with handle rotation also being downward. Another is a standard angle mount where the handle is disposed in either a vertical or a horizontal position and can be pushed or pulled depending on the internal configuration of the toilet tank. In any one of the operational positions, it would be desirable that the lever consistently return to its default or neutral position irrespective of the orientation of the handle relative to the tank. That is, it would be desirable to provide a "dual action" for the handle whereby rotation of the handle in two different directions always results in the handle returning to its default position, i.e. horizontal or vertical.

There is also a need for such a handle and flush lever such that one portion of the flush lever can be variably adjustable within 360° of rotation and by adjustments every 15° for optimal placement of the flush lever as desired or required. Lastly, there is also a need to provide another portion of the flush lever that can be variably adjustable within 180° of rotation and by adjustments also every 15°. Such would allow the wide variety of handle placements as discussed above.

SUMMARY OF THE INVENTION

In accordance with the foregoing, an improved flush lever has been devised by this inventor which accomplishes the goals identified above. As used in this disclosure, the term "flush lever" means the exterior handle, the interior lever and the interposed mechanical coupling. It is also to be understood that use of the improved flush lever with a conventional water tank, for purposes of this disclosure, comprises an "assembly."

More specifically, the flush lever of the present invention comprises a handle and a skirt, or escutcheon plate, both disposed to the exterior of the tank. Within the tank is a flush lever subassembly, the subassembly taking one of two different embodiments and each embodiment comprising means for mechanically linking the flush lever with the subassembly.

One embodiment uses a semi-metallic handle and skirt, the semi-metallic handle and skirt having a die cast configuration. In that embodiment, it is to be understood that the semi-metallic structures could be made of brass, aluminum or zinc using the die case process. A second embodiment uses a plastic handle and skirt, the plastic handle being attached by means of a "snap on" configuration such that the handle becomes non-removable once assembled, or snapped on. Further, the plastic chosen for the handle and skirt of the second embodiment can be molded in virtually any color and the plastic chosen can also be painted by the end user to accommodate the user's liking or decor. Each embodiment uses other components, many of which are common to both.

The foregoing and other features of the flush lever and the assembly of the present invention will be apparent from the following detailed description when read in conjunction with the accompanying drawings.

DETAILED DESCRIPTION

Figure 1:
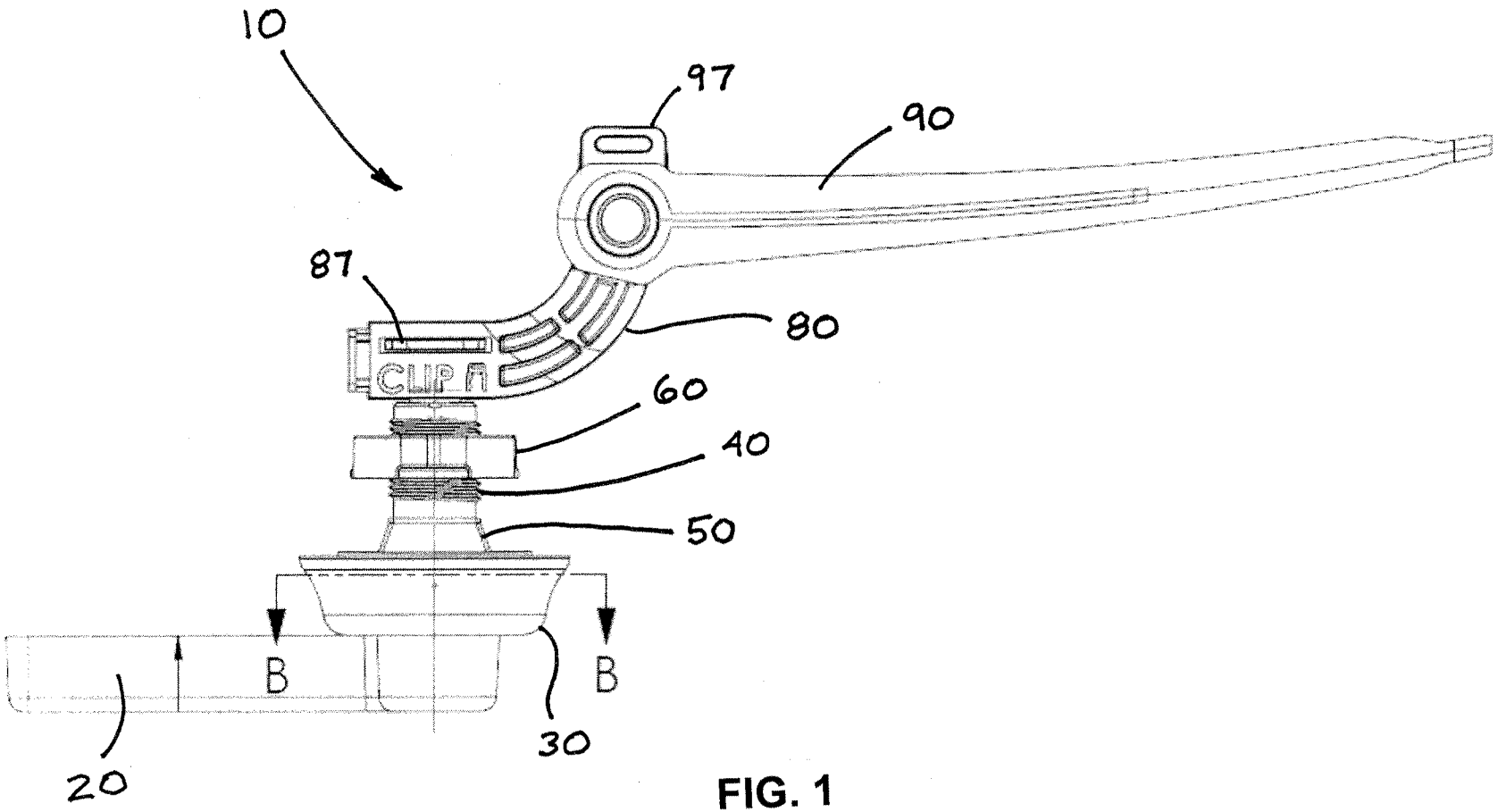
FIG. 1 is a top plan view of a first preferred embodiment of a flush lever constructed in accordance with the present invention.

Referring now to the drawings in detail, wherein like-numbered elements refer to like elements throughout, FIG.

1 illustrates a top plan view of a first preferred embodiment of the flush lever, generally identified 10, of the present invention, which flush lever 10 is the type that would be mounted within a toilet tank (not shown). As shown, the flush lever 10 comprises a tank handle 20, a "skirt" or escutcheon plate 30, a connector or "tank handle stop" 40, an adapter 50, a nut 60, a lock pin 70, a "segment" or connecting arm 80, and a lever 90.

The connecting arm 80 has 360° of rotation and can be adjusted every 15°. The connecting arm 80 is held in place by a retention clip 87. See also FIG. 2. This retention clip 87 must be removed to adjust the position of the connecting arm 80. On an end of the connecting arm 80, there is a holder for the clip 87 so that it does not get lost. Similarly, the lever 90 has 180° of rotation and can be adjusted every 15° as well. The lever 90 is held in place by a retention clip 97 as well. This retention clip 97 must be removed to adjust the position of the lever 90.

In this first configuration, the tank handle 20 and the skirt 30 are made of a semi-metallic alloy, which is a first preferred embodiment. Again, in this first embodiment, it is to be understood that the semi-metallic structures could be made of brass, aluminum or zinc using the die case process.

Figure 5:
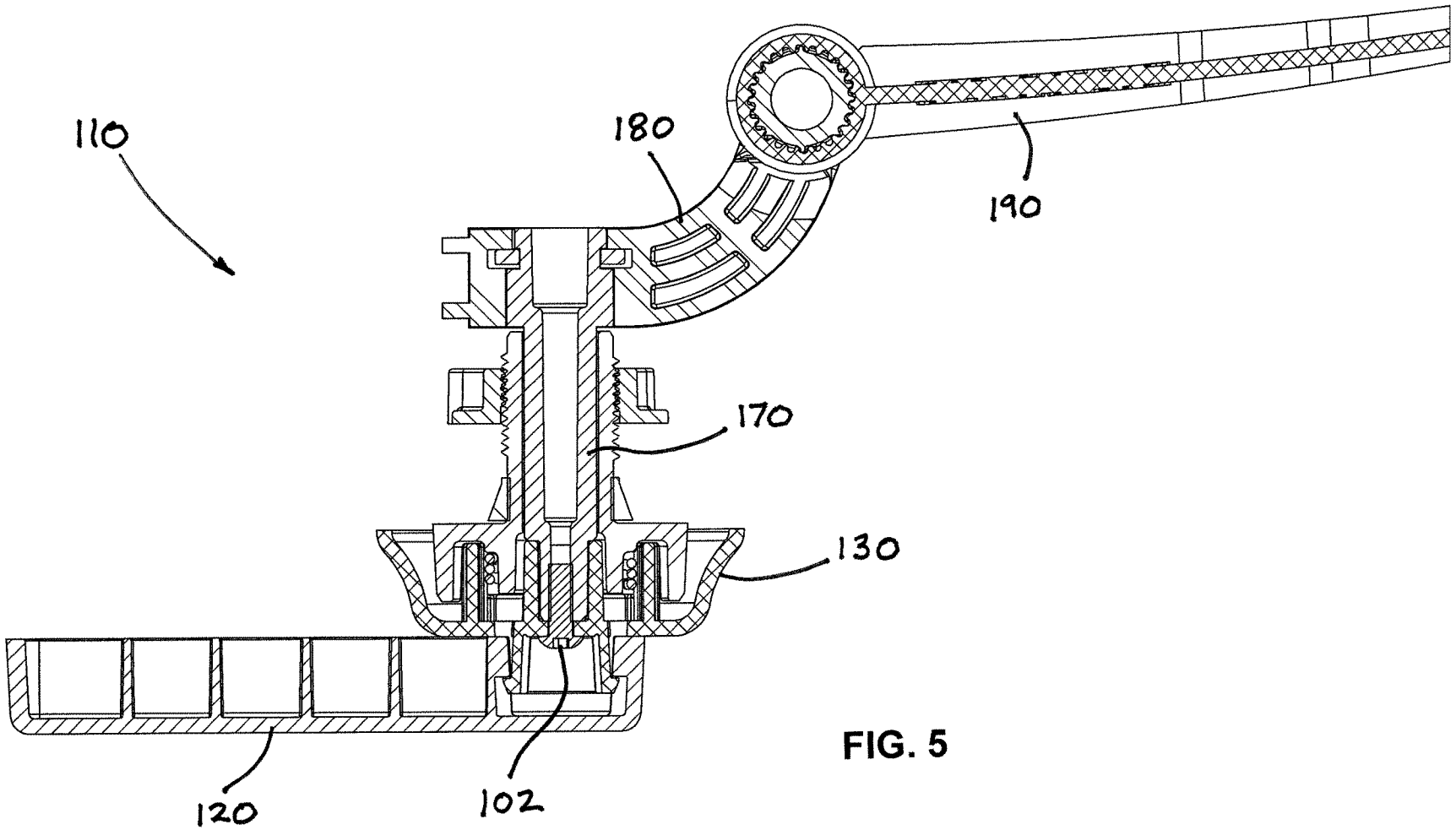
FIG. 5 is a cross sectioned view similar to that shown in FIG. 2, but of a second preferred embodiment of the present invention.

FIG. 5 illustrates the plastic counterpart 110 of the present invention. This is a second preferred embodiment and its components are slightly different, but not completely, and will be discussed in further detail below.

Figure 2:
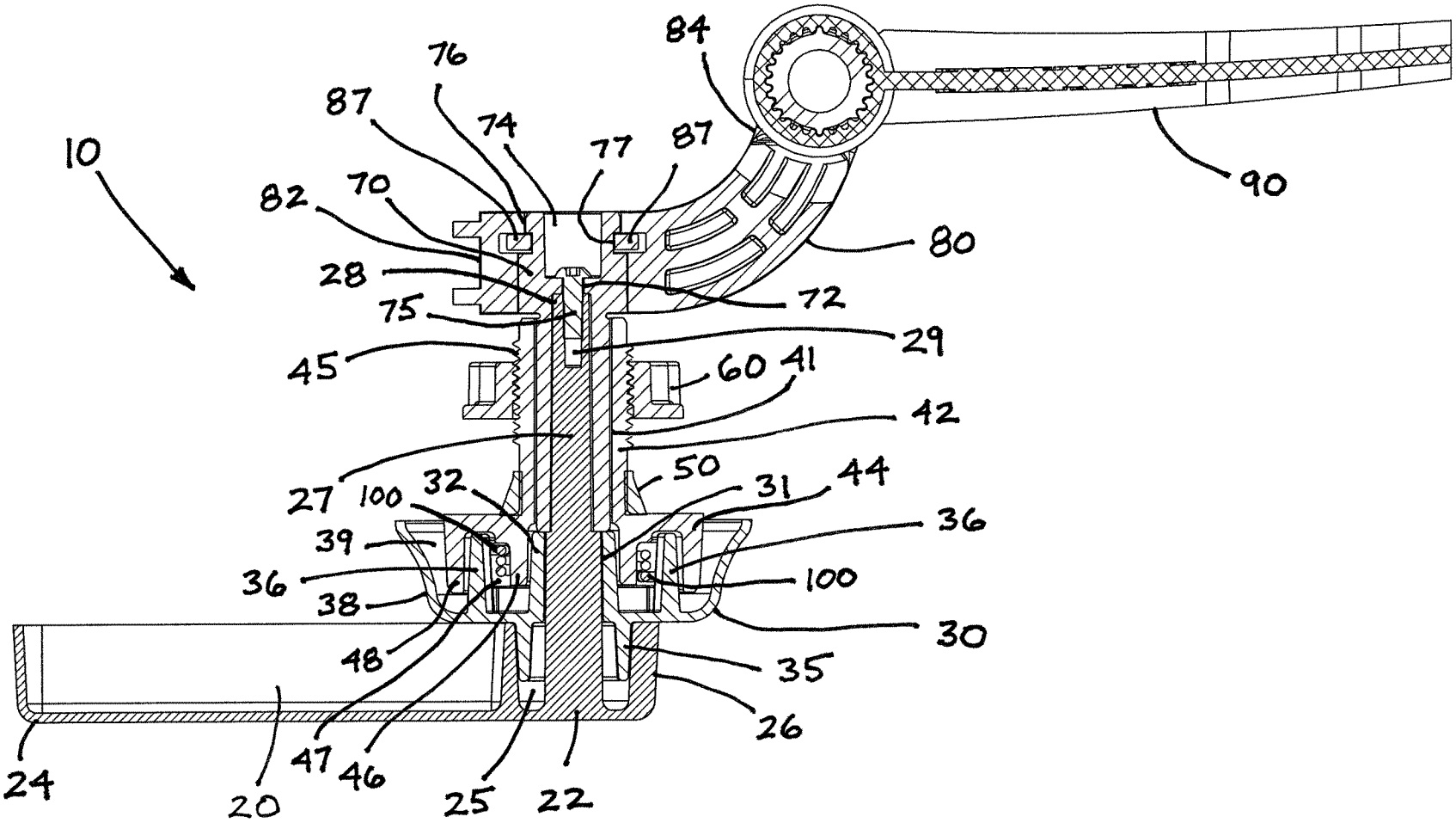
FIG. 2 is a cross sectioned view of the flush lever shown in FIG. 1.

Referring specifically now to FIG. 2, it shows a cross-section of the flush lever 10 shown in FIG. 1. As shown, the tank handle 20 comprises a proximal handle portion 22, a distal handle portion 24 and an annular ring 26 disposed about the proximal handle portion 22, but separated from the proximal handle portion 22 by an annular gap 25. The proximal handle portion 22 further comprises a shaft 27 that extends inwardly and has an aperture 29 defined in the distal end 28 of the shaft 27. Again, in this first embodiment, the tank handle 20 and its component parts are preferably made of a single piece of semi-metallic alloy material.

Moving inwardly (since the tank handle 20 is intended to be disposed to the exterior of the water tank), it will be seen that an escutcheon or skirt 30 is provided (or, simply, skirt). This skirt 30 comprises a centrally disposed portion 32 having an aperture 31 defined in it. Moving outwardly from the centrally disposed portion 32, it will be seen that the skirt 30 further comprises an outwardly extending annular ring 35, which ring 35 is functionally adapted to fit within the annular gap 25 of the handle 20. This structure maintains the general alignment between the handle 20 and the skirt 30. Moving outwardly from the center of the skirt 30, it will be seen that the skirt 30 further comprises a pair of inwardly extending annular arcs 36 and a contoured inwardly extending annular ring 38. An annular space 39 is disposed between those two structures 36, 38. The contoured annular ring 38 is that portion of the skirt 30 that is visible to the user and is also disposed at the outer surface of the water tank (not shown). Again, in this first embodiment, the skirt 30 and its component elements are preferably made of a single piece of semi-metallic alloy material.

Figure 3:
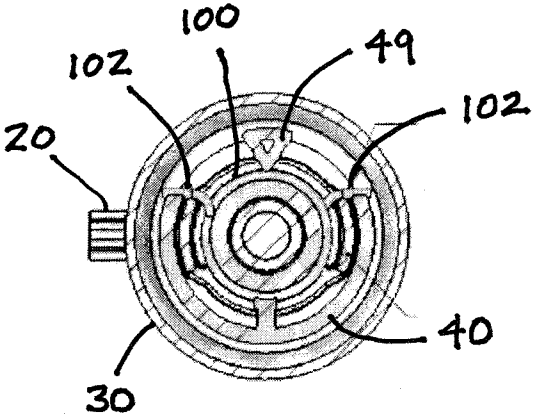
FIG. 3 is a cross sectioned view of a portion of the flush lever taken along line B-B of FIG. 1.

Extending from the tank exterior to the tank interior is a centrally disposed connector 40, which is also referred to herein as a "tank handle stop." This tank handle stop or connector 40 comprises a central portion 42 having an aperture 41 defined axially within it. At a first end 44 of the connector 40, which first end 44 extends outwardly of the water tank, a first annular ring 46 is provided as is a second annular ring 48, although the second annular ring 48 is not a complete ring—it is interrupted, as is shown in FIG. 3 and discussed below. Further, where a portion of the second annular ring 48 is nonexistent, there is instead a spring rotational stop 49; again, see FIG. 3. The diameter of the second annular ring 48 is greater than that of the first annular ring 46. As shown, the first annular ring 46 creates a cavity 47 between it and the first inwardly extending annular ring 36 of the skirt 30. The second annular ring 48 is disposed within the annular space 39 created between the arcs 36 and ring 38 of the skirt 30. Inwardly of the connector 40 (relative to the water tank), an outer threaded portion 45 is provided. This threaded portion 45 is provided such that a like-threaded nut 60 can secure the connector 40 to the wall of the water tank from the interior side of the wall.

Disposed opposite the nut 60 is a circumferential adapter 50 which allows a tight and water-proof connection of the flush lever 10 to the water tank wall. This adapter 50 is preferably made of rubber and is designed to adapt to the smallest and largest square hole in the tank wall. This allows the assembly (i.e. the lever 10 together with the tank) to remain located in its tightened position which is critical to opening the flapper properly and consistently. Further, the adapter 50 acts as a spring washer when under compression. Accordingly, the use of a low compression set rubber is key to this preferred embodiment.

At the distal end 28 of the handle shaft 27 is a lock pin 70 having a first centrally disposed aperture 72 and a second centrally disposed aperture 74, the diameter of the latter being smaller than that of the former. In this way, a self-tapping screw 75 can be introduced to the handle shaft 27 via the first centrally disposed aperture 72 and the screw 75 can be secured within the second aperture 74 to secure the handle 20 to the lock pin 70. The lock pin 70 further comprises a circumferential notch 77 about its upper perimeter 76. The notch 77 is used to receive a retention clip 87 that attaches a proximal portion 82 of the "segment" 80 (which is effectively a 90° elbow) to the lock pin 70. One of the key features of the preferred embodiment is that this connecting arm 80 has 360° rotation and can be adjusted every 15° to achieve a desired positioning. The connecting arm 80 is held in place by the retention clip 87. The clip 87 must be removed to adjust the positioning of the connecting arm 80. Further, on the proximal portion 82 of the connecting arm 80 is a holder for the clip 87 so that the clip 87 does not get lost.

Figure 4:
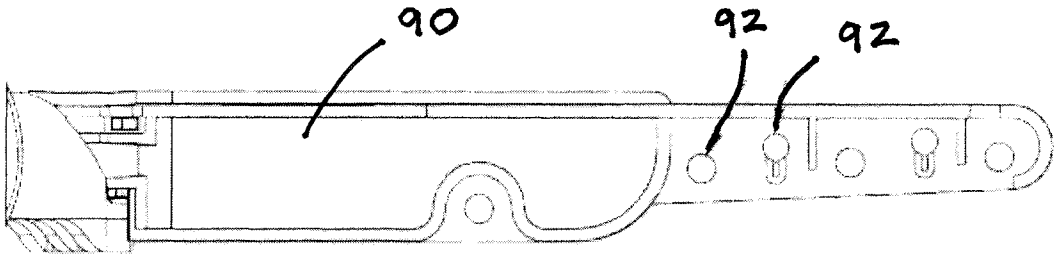
FIG. 4 is an enlarged front elevation view of a portion of the flush lever.

As shown in FIG. 2, the connecting arm 80 also comprises a distal portion 84 to which is attached the flush lever 90, the lever 90 having a number of lever holes 92 to allow all types of lanyards, loop chains and beaded chains (not shown) that are connected to a flapper (also not shown) that is disposed at the bottom of the water tank. See FIG. 4. More significantly, the lever 90 also has 180° of rotation and it can be adjusted every 15° as well. The lever 90 is likewise held in place by a retention clip 97. The retention clip 97 must also be removed to adjust the lever 90.

Referring specifically now to FIG. 3, it shows a cross-section of the skirt 30 and connector 40 taken along line B-B of FIG. 1 wherein an additional significant functional feature of the present invention is illustrated. Specifically, a spring 100 is assembled to the tank handle stop 40. When the spring 100 is so assembled, it has a small amount of preload on it. This allows the lever 90 to return consistently back to the neutral position. As shown in FIG. 3, the spring 100 comprises two ends 102 each of which is held to movement within only a portion of the skirt 30 and the tank handle stop 40. As previously alluded to, a spring rotational stop 49 is also provided.

Referring to FIG. 5, it shows a cross sectioned view of the structure 110 of the second preferred embodiment of the present invention. The differences in structure are that the handle 120 and skirt 130 are snap fitted together. Prior to snap fitting the handle 120, a self-tapping screw 102 is inserted into one end of a much longer lock pin 170 to secure the connecting arm 180 and lever 190 to the structure 110. Once snapped into place, the handle 120 is not intended to be removed. In all other respects, the functionality of the second embodiment is substantially similar to that of the first embodiment.

What is claimed is:

1. A flush lever for use with a gravity flush toilet, the toilet comprising a water tank having a tank exterior, a tank interior, a tank wall separating the tank exterior from the tank interior and a tank wall aperture connecting the tank exterior to the tank interior, the flush lever comprising:

a handle disposed at the tank exterior;

an escutcheon plate disposed at the tank exterior;

a tank handle stop extending through the tank wall aperture;

a lock pin extending through the tank wall aperture;

a connecting arm disposed within the tank interior;

a first removable retention clip for securing the connecting arm to the lock pin;

a lever disposed within the tank interior; and a second removable retention clip for securing the lever to the connecting arm;

wherein the first and second removable retention clips are like configured and interchangeable with one another.

2. The flush lever of claim 1 wherein the connecting arm is rotatably movable 360° about the lock pin and wherein the connecting arm is further fixable in position relative to the lock pin every 15°.

3. The flush lever of claim 1 wherein the lever is rotatably movable 360° about the connecting arm and wherein the lever is fixable in position relative to the connecting arm every 15°.

4. The flush lever of claim 1 wherein the connecting arm further comprises a holder for the connecting arm retention clip.

5. The flush lever of claim 1 wherein a dual action for the handle is provided whereby rotation of the handle in two different directions always results in the handle returning to a horizontal or vertical default position.

6. The flush lever of claim 5 wherein the lever has a neutral position and a flush position, and the flush lever further comprising a spring that has an amount of preload on it such that the lever consistently returns to the neutral position from the flush position as the handle returns to its default position.

7. The flush lever of claim 1 further comprising an adapter, the adapter acting as a spring washer when under compression and being constructed of a low compression set rubber.

8. The flush lever of claim 1 wherein the handle and the escutcheon plate are made of a semi-metallic alloy.

9. The flush lever of claim 1 wherein the handle and the escutcheon plate are made of a plastic material and are attached using a snap-on configuration.

10. A flush lever assembly comprising:

a toilet comprising a water tank having a tank exterior, a tank interior, a tank wall separating the tank exterior from the tank interior and a tank wall aperture connecting the tank exterior to the tank interior;

a flush lever handle disposed at the tank exterior;

an escutcheon plate disposed at the tank exterior;

a tank handle stop extending through the tank wall aperture;

a lock pin extending through the tank wall aperture;

a connecting arm disposed within the tank interior;

a first removable retention clip for securing the connecting arm to the lock pin;

a lever disposed within the tank interior; and a second removable retention clip for securing the lever to the connecting arm;

wherein the first and second removable retention clips are like configured and interchangeable with one another.

11. The flush lever assembly of claim 10 wherein the connecting arm is rotatably movable 360° about the lock pin and wherein the connecting arm is further fixable in position relative to the lock pin every 15°.

12. The flush lever assembly of claim 10 wherein the lever is rotatably movable 360° about the connecting arm and wherein the lever is fixable in position relative to the connecting arm every 15°.

13. The flush lever assembly of claim 10 wherein the connecting arm further comprises a holder for the connecting arm retention clip.

14. The flush lever assembly of claim 10 wherein a dual action for the handle is provided whereby rotation of the handle in two different directions always results in the handle returning to a horizontal or vertical default position.

15. The flush lever assembly of claim 14 wherein the lever has a neutral position and a flush position, and the flush lever further comprising a spring that has an amount of preload on it such that the lever consistently returns to the neutral position from the flush position as the handle returns to its default position.

16. The flush lever assembly of claim 10 further comprising an adapter, the adapter acting as a spring washer when under compression and being constructed of a low compression set rubber.

17. The flush lever assembly of claim 10 wherein the handle and the escutcheon plate are made of a semi-metallic alloy.

18. The flush lever assembly of claim 10 wherein the handle and the escutcheon plate are made of a plastic material and are attached using a snap-on configuration.

* * * * *